US007086327B2

(12) United States Patent
Futamura et al.

(10) Patent No.: US 7,086,327 B2
(45) Date of Patent: Aug. 8, 2006

(54) PRESS FORMING METHOD

(75) Inventors: Shoji Futamura, Kawasaki (JP); Keizo Unno, Tokyo (JP)

(73) Assignee: Hoden Seimitsu Kako Kenkyusho Co., Ltd. (JP)

( * ) Notice: Subject to any disclaimer, the term of this patent is extended or adjusted under 35 U.S.C. 154(b) by 0 days.

(21) Appl. No.: 10/524,322

(22) PCT Filed: Oct. 9, 2003

(86) PCT No.: PCT/JP03/12939

§ 371 (c)(1),
(2), (4) Date: Feb. 9, 2005

(87) PCT Pub. No.: WO2004/037530

PCT Pub. Date: May 6, 2004

(65) Prior Publication Data

US 2005/0257697 A1 Nov. 24, 2005

(30) Foreign Application Priority Data

Oct. 25, 2002 (JP) ..... 2002-311076

(51) Int. Cl.
*B30B 13/00* (2006.01)
*B21C 51/00* (2006.01)

(52) U.S. Cl. ..... 100/35; 100/46; 72/20.1; 72/31.11; 72/389.3; 72/443

(58) Field of Classification Search ..... 100/35, 100/46, 258 R, 258 A; 72/20.1, 31.1, 31.11, 72/31.8, 389.3, 443, 454
See application file for complete search history.

(56) References Cited

U.S. PATENT DOCUMENTS

| | | | | |
|---|---|---|---|---|
| 4,797,831 | A * | 1/1989 | Dressing et al. | 700/165 |
| 4,828,474 | A * | 5/1989 | Ballantyne | 425/150 |
| 6,189,364 | B1 * | 2/2001 | Takada | 72/702 |
| 6,595,122 | B1 * | 7/2003 | Mukai et al. | 100/46 |
| 6,810,704 | B1 * | 11/2004 | Futamura et al. | 72/17.2 |

FOREIGN PATENT DOCUMENTS

| | | |
|---|---|---|
| EP | 1 240 999 A1 | 9/2002 |
| JP | 10-277791 | 10/1998 |
| JP | 2000-15341 | 1/2000 |
| JP | 2000-79500 | 3/2000 |

* cited by examiner

*Primary Examiner*—Derris H. Banks
*Assistant Examiner*—Jimmy T. Nguyen
(74) *Attorney, Agent, or Firm*—McGlew and Tuttle, PC

(57) ABSTRACT

A press forming method is disclosed, wherein press forming can be effected at high speed while maintaining the horizontal state of a slide plate in press-forming work by a press machine. A press machine is used in which the slide plate is pressed by a plurality of servo-motor drive sources. In trial forming, the slide plate is sufficiently slowly moved to measure the delay of each drive source. According to the magnitude of the delay of each drive source or according to the difference between the trial forming speed and the production forming speed, the respective speeds of the drive sources are corrected, and trial forming is repeated on the basis of the corrected speed to derive conditions that enable press forming at high forming speed suitable for mass production while maintaining the horizontal state of the slide plate to the extent of ensuring sufficient product accuracy.

5 Claims, 5 Drawing Sheets

PRESS FORMING METHOD

TECHNICAL FIELD

The invention relates to a press forming method in which a slide plate is maintained to be horizontal during press forming, using a press machine that drives a slide plate or a pressing plate by a plurality of drive sources, e.g. servo-motors, to press-form.

BACKGROUND ART

A press machine for press-forming a work-piece has a structure which has a fixed plate, a slide plate opposite to the fixed plate, a fixed die disposed on the fixed plate and a movable die disposed on the slide plate facing the fixed plate to open and close the movable die against the fixed die by moving the slide plate relatively to the fixed plate. In a small press machine, there is a single drive source provided in a center of a slide plate. Using a large slide plate, the single drive source disposed in a center of the slide plate cannot uniformly press the slide plate. Therefore, using a plurality of drive sources to cause a uniform pressing force on a slide plate, each of the plurality of drive sources presses a respective engaging portion disposed on the slide plate to form a press plane on the slide plate. As the plurality of drive sources, two, four or six ones, for example, have been used.

When a slide plate is descending against a fixed plate to close a movable die against a fixed die and to increase a pressing force, magnitudes of loads working on the movable die through a plate to be formed are changing and working positions of the loads on the movable die are, also, varying. The variations of the magnitudes and the working positions of the loads cause imbalance on load working on the slide plate. A distance from a working position of a load on the slide plate to a drive source, also, is varied. Then, imbalance in load moments acting to the drive sources is caused.

When servo-motors are used for drive sources of a press machine, revolutions of the servo-motors are delayed by loads working to the drive sources. So, since a drive source subjected to a large load is more delayed in proceeding than a drive source subjected to a small load, a slide plate is caused to incline relatively to a fixed plate. The inclination of the slide plate causes a die to incline and often to be injured. When the inclination of the slide plate is small, the die is not injured but may reduce accuracy in press-forming a work-piece.

As a countermeasure, an inclination of a slide plate has been corrected by detecting/measuring the inclination of the slide plate during a progress of the press-forming and adjusting a driving signal supplied to each of the drive sources to reduce/eliminate the inclination of the slide plate. Such a feed-back control can prevent the slide plate from inclining during press-forming.

However, when a slide plate inclination is prevented during press-forming by the feed-back control, a cycle of press forming takes a long time. In a press-forming of a work piece, it is usual that a same kind of work-pieces is repeatedly formed to produce a large number of work-pieces. If a cycle of press-forming takes a long time, there is a problem that a production of a large number of work-pieces takes an extremely long time.

DISCLOSURE OF THE INVENTION

An object of the invention, therefore, is to provide a press-forming method that enables press-forming at a high forming speed suitable for mass production, while maintaining a slide plate horizontal.

A press forming method of the invention comprises the steps of:

providing a press machine comprising
- a fixed plate,
- a slide plate disposed to face the fixed plate and movable relatively to the fixed plate and
- a plurality of drive sources each having a servo-motor for driving the slide plate and pressing each of a plurality of engaging portions positioned on the slide plate to press horizontally the slide plate, and press-forming a work-piece at descending speeds of the plurality of drive sources in a trial forming, in which the descending speeds are set to be sufficiently small and same among the plurality of drive sources at an initial stage of the trial forming and then adjusted so as to be close to target speeds of a production forming and so that a delay difference between a displacement of each of the plurality of drive sources and an instructed displacement is less than a predetermined value, by a delay adjustment step among the drive sources and a driving speed increasing step, wherein, in the delay adjustment step, each of the descending speeds for the plurality of driving sources is adjusted by such a speed increment that the delay difference becomes less than or equal to the predetermined value, and, in the driving speed increasing step, the descending speeds for the plurality of driving sources are adjusted to increase more than in the delay adjustment step and close to the target speeds of the production forming.

Saying in more detail, the press forming method of the invention comprises the steps of.

providing a press machine comprising
- a fixed plate,
- a slide plate disposed to face the fixed plate and movable relatively to the fixed plate and
- a plurality of drive sources each having a servo-motor for driving the slide plate and pressing each of a plurality of engaging portions positioned on the slide plate to press horizontally the slide plate, and press-forming a work-piece at sufficiently small and same descending speeds among the plurality of drive sources in a trial forming, measuring a displacement delay of each of the plurality of drive sources from an instructed displacement during the trial forming, comparing a difference between a displacement delay (hereinafter referred to as "reference delay") of a drive source (hereinafter referred to as "reference drive source") among the plurality of drive sources from the instructed displacement and a displacement delay of each of other drive sources than the reference drive source from the instructed displacement with a predetermined value and comparing a descending speed of each of the plurality of drive sources during the trial forming with a target speed of the drive source for a production forming, if the difference between the reference delay and the displacement delay of one of the other drive sources is more than the predetermined value, preparing a speed increment (hereinafter referred to as "compensation increment") for the one of the other drive sources, corresponding to the difference between the reference delay and the displacement delay so as to eliminate the difference between the reference delay and the displacement delay for the one of the other drive sources to add the compensation increment to the descending speed of the trial forming for the one of the other drive sources, if a difference between the descending speed of each of the plurality of drive sources during the trial forming and the target speed of the drive source for the production forming is more than a predetermined speed difference, preparing a speed increment so as to make the descending speed close to a target speed for the drive source to add the speed increment to the descending speed, press-forming a work-piece at descending speeds adjusted with the compensation increment and/or the speed increment for a repeated trial forming, measuring a displacement delay of each of the plurality of drive sources from an instructed displacement during the repeated trial forming, comparing a difference between a reference delay of a reference drive source among the plurality of drive sources and a displacement delay of each of other drive sources than the reference drive source from the instructed displacement with the predetermined value and comparing the adjusted descending speed with the target speed for the production forming, repeating the step of preparing the compensation increment and the steps following the step of preparing the compensation increment, until the difference between the reference delay and the displacement delay becomes less than or equal to the predetermined value and until the difference between the descending speed and the target speed becomes within the predetermined speed difference, and if the difference between the reference delay and the displacement delay becomes less than or equal to the predetermined value and the difference between the descending speed and the target speed becomes within the predetermined speed difference, press-forming a work-piece at the descending speed for each of the plurality of drive sources in a production forming.

In the press forming method described above, it is desirable that the reference drive source is a drive source having a minimum displacement delay from the instructed displacement at a displacement among the plurality of drive sources.

Also, in the press forming method of the invention, it is desirable that the predetermined value for comparing the difference between the displacement delay of each of the plurality of drive sources and the reference delay is a first predetermined value, and the method further comprises:

judging whether or not the difference between the reference delay and the displacement delay of each of the other drive sources is more than a second predetermined value that is less than the first predetermined value, if, in any of the steps of comparing the difference and the descending speed, the difference is less than or equal to the first predetermined value and a difference between a descending speed of a drive source in the trial forming and the target speed is within the predetermined speed difference, if the difference between the reference delay and the displacement delay is more than the second predetermined value, preparing an additional compensation increment, corresponding to the difference between the reference delay and the displacement delay, to add the additional compensation increment to the descending speed of the drive source, repeating the steps of judging and preparing, until the difference between the reference delay and the displacement delay becomes less than or equal to the second predetermined value, and if the difference between the reference delay and the displacement delay becomes less than or equal to the second predetermined value, press-forming a work-piece in a production forming.

BEST MODE FOR CARRYING OUT OF THE INVENTION

Figure 1:
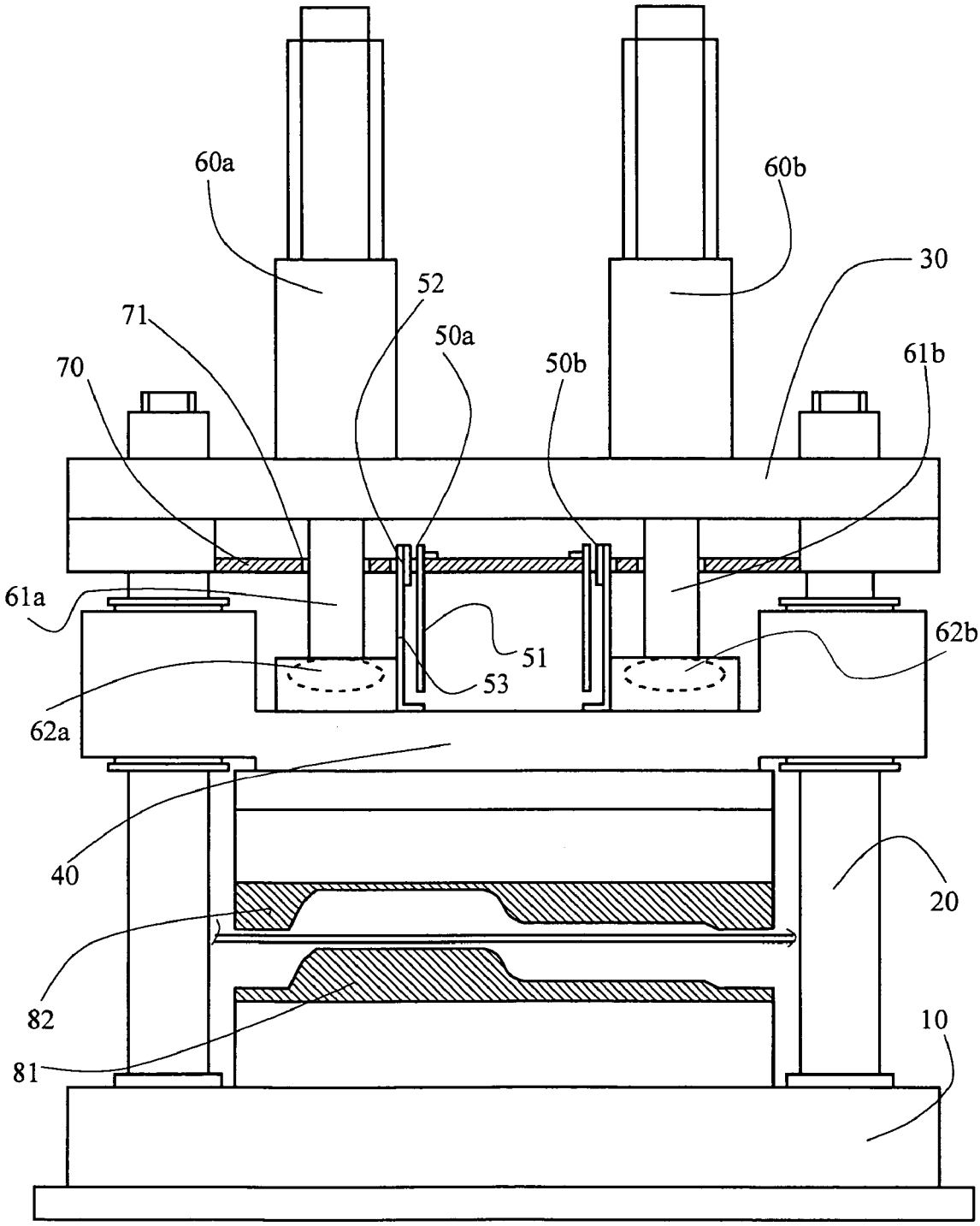
FIG. 1 is a front view of a press machine which can be used for the invention.
Figure 2:
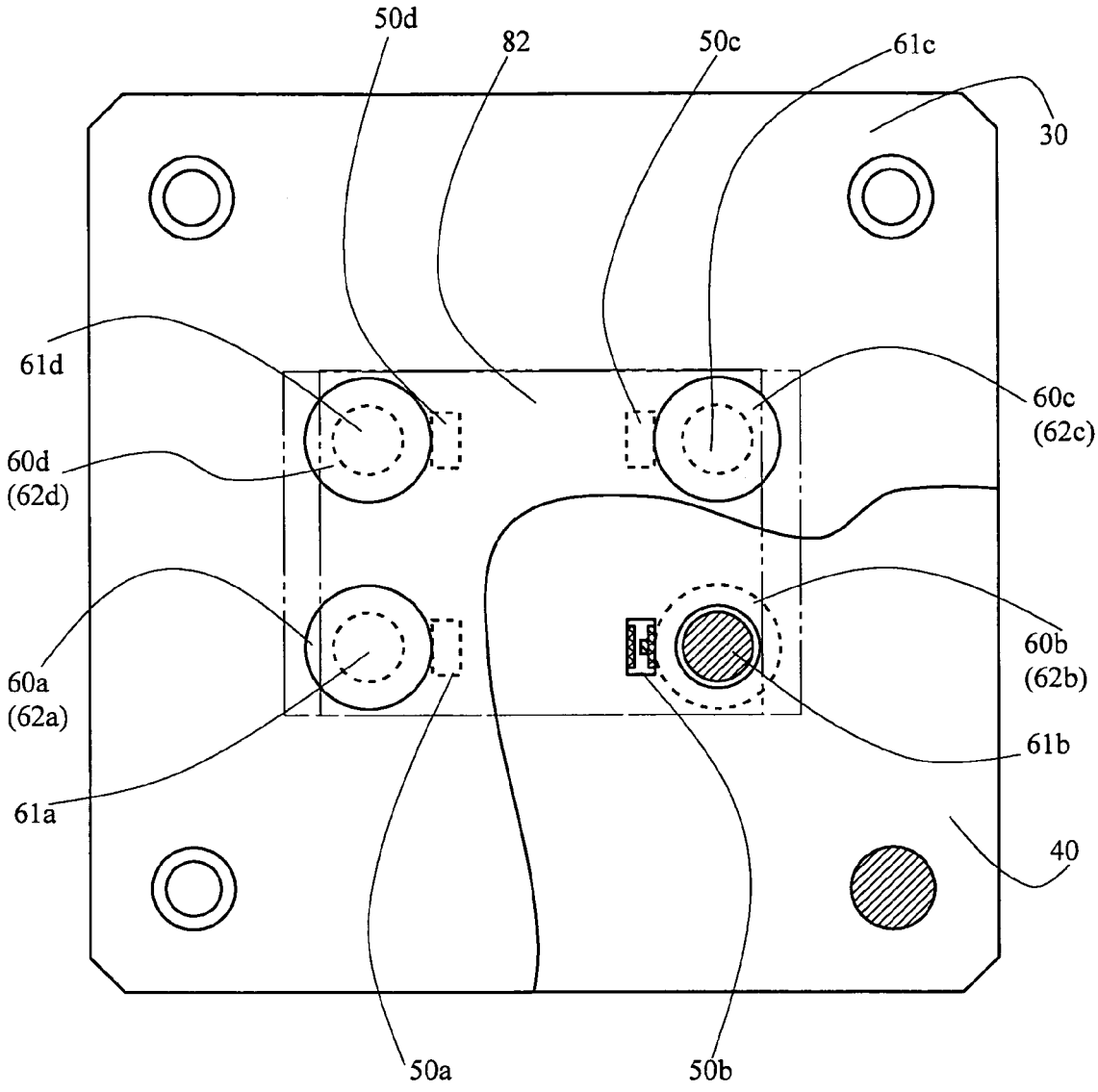
FIG. 2 is a plan view showing the press machine shown in FIG. 1 with an upper support plate being partially removed.

Referring to FIGS. 1 and 2 first, an example of a press machine which can be used for the invention will be described. FIG. 1 is a front view of the press machine, and FIG. 2 is a plan view of the press machine. In FIG. 2, the press machine is shown with an upper support plate partially removed. The press machine has a lower support base 10 fixed on a floor surface, and has an upper support plate 30 by supporting columns 20 made upright on the lower support base. A slide plate 40 capable of reciprocating along the supporting columns 20 is provided between the lower support base 10 and the upper support plate 30, and a forming space exists between the slide plate and the lower support base. In this forming space, a fixed die (lower die) 81 for press-forming is mounted on the lower support base, while a movable die (upper die) 82 corresponding to the fixed die is mounted on an undersurface of the slide plate, and for example, a plate to be formed is placed between these dies and press-formed.

Four of the combinations of servo-motors and decelerating mechanisms are mounted on the upper support plate 30 as drive sources 60*a*, 60*b*, 60*c* and 60*d*. Drive shafts 61*a*, 61*b*, 61*c* and 61*d* that extend in a downward direction from each of the drive sources through through-holes provided in the upper support plate 30 are engaged with each of engaging portions 62*a*, 62*b*, 62*c* and 62*d* on the slide plate 40. For example, a ball screw is attached to each of the drive shafts so as to convert revolution into an up and down movement, and the slide plate is moved up and down by revolution of the serve-motors. Driving mechanisms are constructed by the drive sources, the drive shafts and the engaging portions.

It is preferable that these drive sources are positioned so that pushing pressure onto the slide plate by a plurality of drive sources 60*a*, 60*b*, 60*c* and 60*d* horizontally presses the slide surface and is distributed uniformly on the slide plate. It is preferable that these servo-motor drive sources generate the pushing pressure of equal magnitude to each other, namely, generate equal output force.

As is apparent from the plan view of FIG. 2, each of the engaging portions 62*a*, 62*b*, 62*c* and 62*d* is provided in a forming area of the forming space. Displacement measuring devices 50*a*, 50*b*, 50*c* and 50*d* are provided near the respective engaging portions 62*a*, 62*b*, 62*c* and 62*d*. As each of the displacement measuring devices 50*a*, 50*b*, 50*c* and 50*d*, a device having a magnetic scale 51 provided with magnetic calibration markings and a magnetic sensor 52 such as a magnetic head provided to face the magnetic scale with a small clearance therebetween can be used. On moving the magnetic sensor 52 relatively to the fixed magnetic scale 51, its absolute position, displacement speed and the like can be measured. Such a displacement measuring device is well known to those skilled in the art as a linear magnetic encoder, and therefore, further explanation will be omitted. As the displacement measuring device, a device which measures a position by light or a sonic wave can be also used. The magnetic scale 51 of each of the displacement measuring devices 50*a*, 50*b*, 50*c* and 50*d* is mounted to a reference plate 70, and the magnetic sensors 52 of the displacement measuring devices are supported by supporting columns 53 mounted to the respective engaging portions 62*a*, 62*b*, 62*c* and 62*d*. Here, the reference plate 70 is maintained at the same position irrespective of the position of the slide plate 40. Therefore, when the slide plate 40 is driven by the drive sources 60*a*, 60*b*, 60*c* and 60*d*, displacement of each of the engaging portions can be measured by the displacement measuring devices 50*a*, 50*b*, 50*c* and 50*d*.

The reference plate 70 that is provided under the upper support plate 30 with a clearance with the upper support plate in FIG. 1, is laid between the supporting columns 20 and fixed, and has a through-hole 71 having a sufficient clearance with the drive shafts at a portion where each of the drive shafts 61*a*, 61*b*, 61*c* and 61*d* is passed, so that any deformation of the drive shafts and the slide plate does not influence the reference plate.

Figure 3:
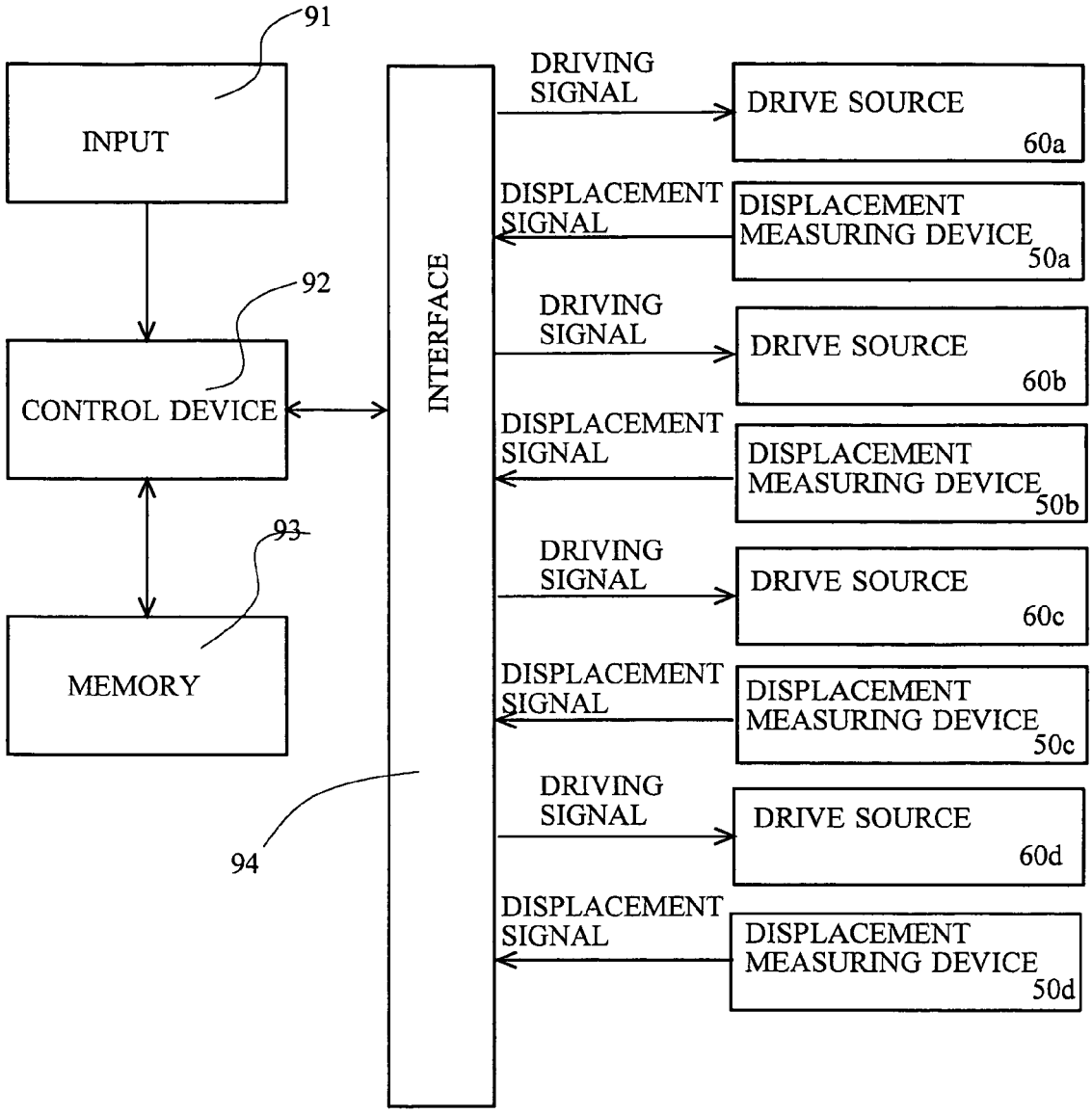
FIG. 3 is a block diagram showing a control system of the press machine which can be used for the invention.

A control system block diagram of the press machine is illustrated in FIG. 3. Before press-forming, for example, a name of a product to be formed, speed of each of the drive sources and the like are inputted to a control device 92 from an input device 91 in advance. The control device 92 has a CPU, to transmit driving signals to the servo-motor drive sources 60*a*, 60*b*, 60*c* and 60*d* through an interface 94 from the control device 92 to drive each of the drive sources and perform press-forming. Displacement signals of the slide plate are transmitted to the control device 92 from the displacement measuring devices 50*a*, 50*b*, 50*c* and 50*d*.

Figure 4:
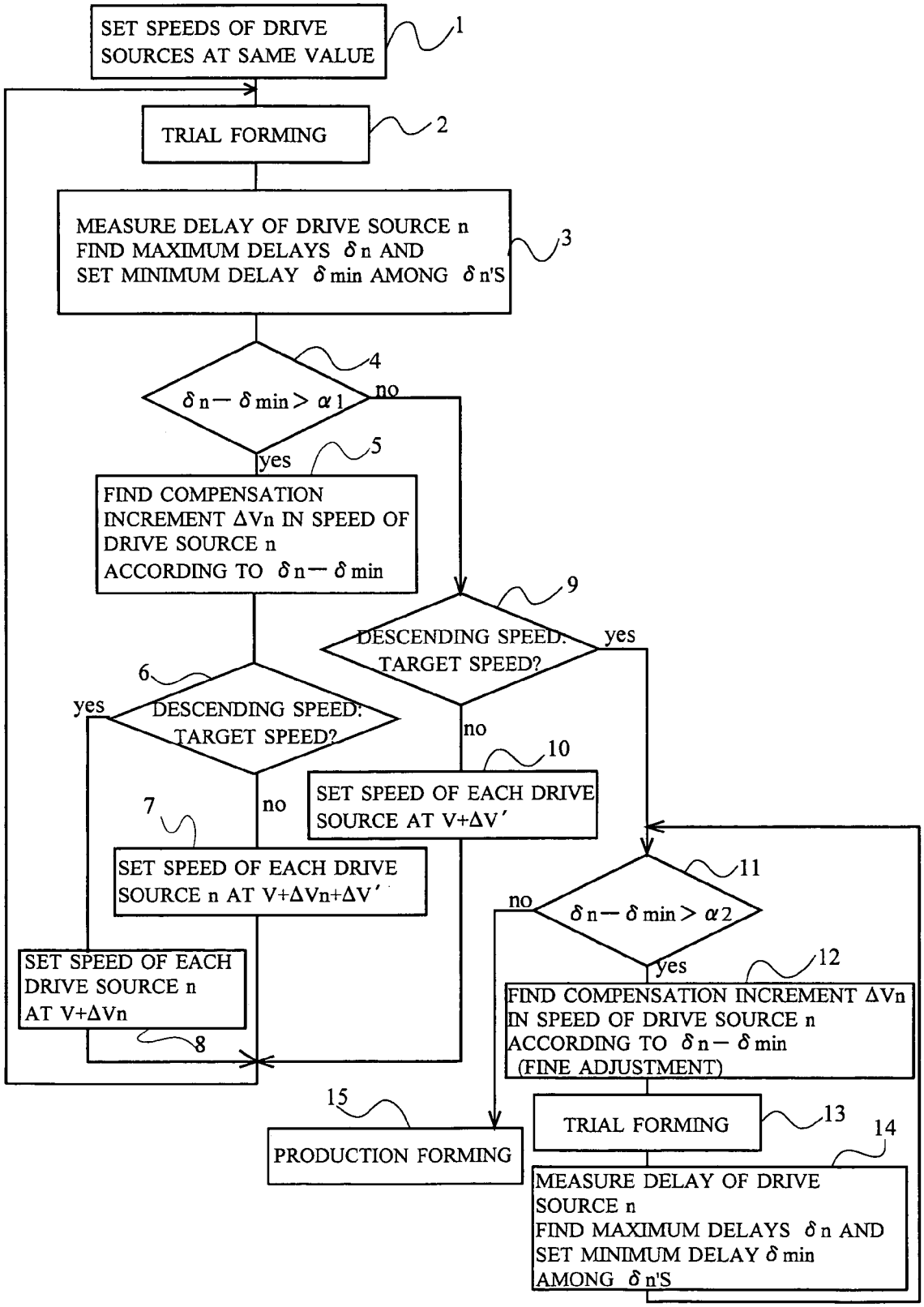
FIG. 4 is a flow chart showing a press forming method according to an example of the invention and FIG. 5 is a graph showing an example of relationship of displacement and delay.

FIG. 4 shows a flow chart of a press forming method according to an embodiment of the invention. In steps 1 and 2 of the flow chart, trial forming of a work-piece is performed by using the press machine explained above. Trial forming of the work-piece is performed by making the drive sources 60*a*, 60*b*, 60*c* and 60*d* descend at slow speed and the same speed among the four drive sources so that the slide plate inclination becomes extremely small. The descending speed is set at sufficiently slow speed V, which does not cause such a large inclination as breaks a mold or dies even if imbalanced load occurs and inclination occurs to the movable die and the slide plate.

When a work-piece is press-formed, a distance by which each of the drive sources descends by a driving signal which is inputted into each of the drive sources when there is no load is referred to as an instructed displacement. Since load acts on each of the drive sources engaged with the slide plate as a result of press-forming a work-piece, the descending distance or displacement of each of the drive sources delays from the instructed displacement due to the load. While trial forming of the work-piece is performed in step 2, delay from the instructed displacement of each of the drive sources is measured in step 3.

In the process of press-forming a work-piece, it is general to change the descending speed of the slide plate at each stage of press-forming the work-piece, such as the stage of forming a large part of the work-piece, the stage of forming a small part of the work-piece, the stage of applying uniform load after the press-forming of the work-piece is substantially finished, and the stage of making the slide plate ascend. At each of these stages, load acting on the slide plate and each of the drive sources from forming dies changes. Thus, it is assumed that the work-piece press-forming process is divided into a plurality of forming stages, and the descending speed of the slide plate can be made constant during each of the stages.

Figure 5:
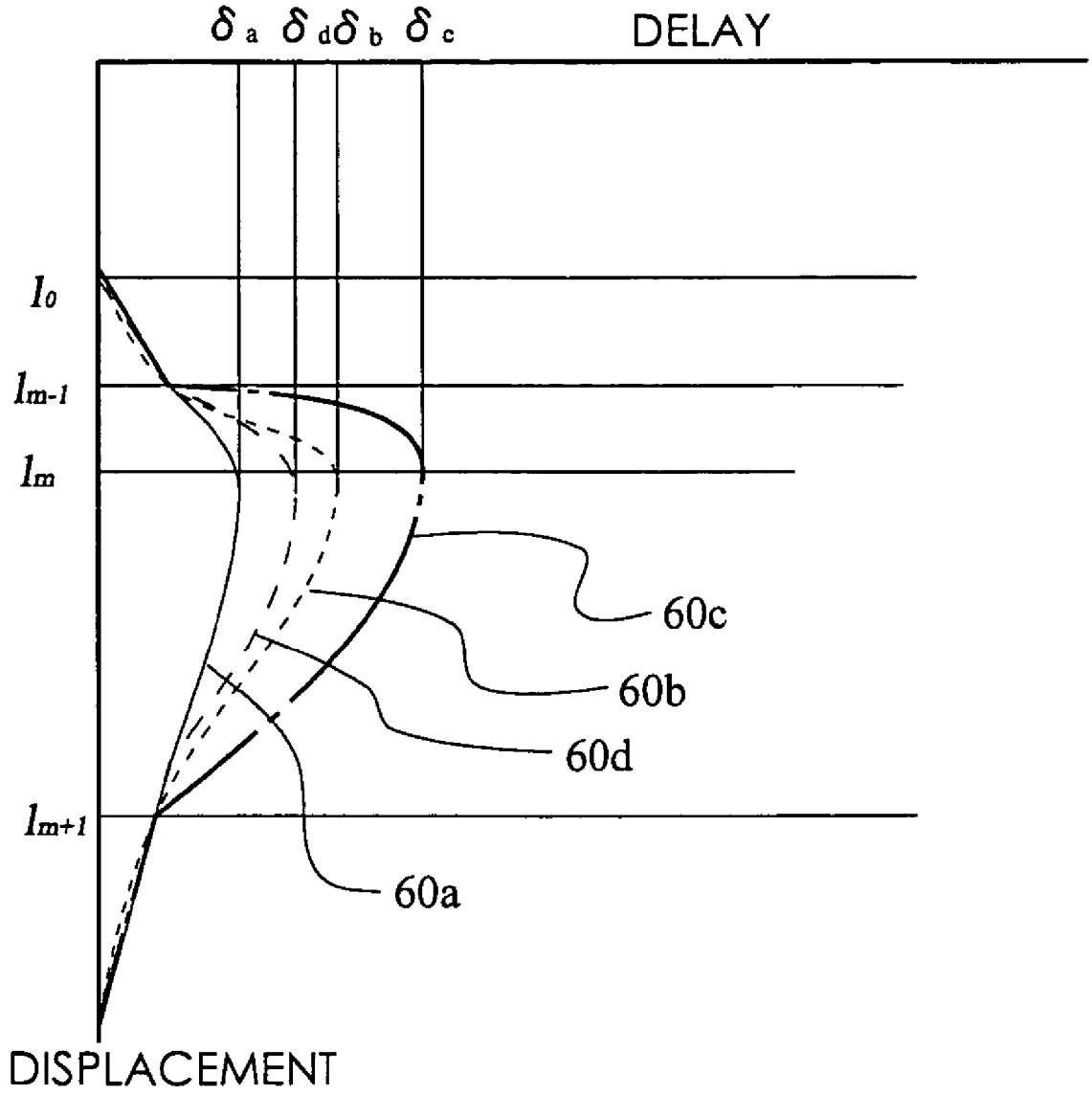

The slide plate descends from displacement 0, and forming starts at displacement $\mathbf{1}_0$, and one of stages of forming is set to be from displacement $\mathbf{1}_{m_1}$ to displacement $\mathbf{1}_{m+}1$. During the forming stage of $\mathbf{1}_{m_{13}1}$ to $1_m$+1, a displacement delay of each of the drive sources 60*a*, 60*c*, 60*c* and 60*d* from an instructed displacement is assumed to be as shown in FIG. 5. In FIG. 5, the vertical axis represents an instructed displacement, and the horizontal axis represents a delay δ of a displacement of the slide plate in the vicinity of the respective drive sources from the instructed displacement. In this example, a delay $\delta_a$ of the drive source 60*a* is the smallest, and delays of the drive sources 60*b* and 60*c* are large. At instructed displacement $\mathbf{1}_{m_1}$, the drive sources 60*b*, 60*c* and 60*d* begin to delay from the displacement of the drive source 60*a*, the delays of the respective drive sources become the maximum at instructed displacement $\mathbf{1}_m$, and displacements of the respective drive sources become the same as instructed displacement $\mathbf{1}_{m+}1$. Thus, in step 3, the maximum delays of the respective drive sources 60*a*, 60*b*, 60*c* and 60*d* are set at $\delta_n$ (n: a, b, c, d). One of these drive sources is called a reference drive source, and a delay of the reference drive source from the instructed displacement is set as a reference delay. In step 3 shown in FIG. 4, the drive source with the minimum delay from the instructed displacement among the maximum delays is set as the reference drive source, and its delay is set at $\delta_{min}$.

After the process step, the difference between the maximum delay of each of the drive sources from the instructed displacement and the reference delay is compared with a predetermined value, and a driving speed of the reference drive source in the trial forming in step 2 is compared with a target speed of the reference drive source for production forming. In the following process steps, speed of each of the drive sources is adjusted so that the slide plate inclination is within a predetermined value, and the speed of each of the drive sources is increased to a target speed for the production forming, to meet the speed of each of the drive sources suitable for the production forming.

The largest delay of each of the drive sources is compared with the delay of the reference drive source (for example, the minimum delay among the maximum delays of the respective drive sources), and it is judged whether the difference between these delays is a difference in delay to such an extent as not to cause damage to the mold, namely, the slide plate inclination is about 100 μm at the maximum or not. As another determination reference, it is judged whether the slide plate inclination is small enough to ensure sufficient production accuracy or not. An allowable value of the slide plate inclination capable of ensuring sufficient product accuracy is required to be extremely smaller than the allowable value of the slide plate inclination to the extent which does not causes damage to the mold, and the judgment reference is that the difference in delay is about 3 μm.

In step 4 in FIG. 4, a first predetermined value α1 is used as the judgment reference. The first predetermined value α1 is a difference in delay to the extent which does not cause damage to the mold described above. It is judged whether the difference between the maximum $\delta_n$ (n: a, b, c, d) of delay of the actual displacement of each drive source n from the instructed displacement and the reference delay is larger than the first predetermined value $\alpha 1$ or not.

When the difference between the maximum delays $\delta_b$, $\delta_c$ and $\delta_d$ of the drive sources 60*b*, 60*c* and 60*d* and the reference delay $\delta_{min}$ is larger than the first predetermined value $\alpha 1$, the flow goes to step 5. In step 5, the speed of each drive source n is compensated in accordance with the difference between the maximum delay $\delta_n$ and the reference delay $\delta_{min}$, so that the difference in delay is eliminated. If the maximum delay among $\delta_b$, $\delta_c$ and $\delta_d$ occurs to the drive source 60*c* as in the example shown in FIG. 5, it is necessary to make the speed of the drive source 60*c* higher by $\Delta V_c$ than the speed of the drive source 60*a*. Here, $\Delta V_c$ is a compensation increment of the drive source 60*c*. Compensation increments of the respective speeds of the drive sources 60*b* and 60*d* may be also prepared as $\Delta V_c \cdot (\delta_b - \delta_{min})/(\delta_c - \delta_{min})$, and $\Delta V_c \cdot (\delta_d - \delta_{min})/(\delta_c - \delta_{min})$. Here, the compensation increment $\Delta V_c$ of the speed of the drive source 60*c* is separately prepared in an experiment or in a simulation. The drive source 60*a* of which maximum delay is the smallest among the drive sources is not included in this loop, and therefore, a compensation increment is not added to the speed of the drive source 60*a*.

In the invention, a compensation increments $\Delta V_n$ (n: b, c, d) of respective speeds of the drive sources can be prepared as follows. A delay $\delta_n$ of an actual displacement from an instructed displacement is generally expressed by a function of a speed $V_n$ and a load Pn in the portion on which the load P acts, and therefore, $\delta_n = f(V_n, Pn)$. The speed $V_n$ at which the delay $\delta_n$ of the drive source n becomes equal to the delay $\delta_{min}$ of the drive source 60*a* can be prepared as follows.

Namely, in order to satisfy $\delta_n - \delta_{min} = 0$, $f(V_n, Pn) = f(V_a, Pa)$ (here, Pa is a load acting on the drive source 60*a*) is satisfied, and therefore the speed $V_n$ required by the drive source n can be prepared by previously measuring the loads Pa and Pn (n: b, c, d) which act on the drive sources 60*a*, 60*b*, 60*c* and 60*d* in each stage of the press-forming. The speed $V_n$ thus prepared is the result of adding the compensation increment $\Delta V_n$ to the speed $V_a$ of the drive source 60*a*. The speed of each of the drive sources can be set by adding 50 to 90% of the prepared compensation increment $\Delta V_n$ by using a safety factor: 50 to 90%.

In step 6, it is judged whether the speed of each of the drive sources is a target speed for the production forming or not. It is judged whether the difference between the speed during the aforementioned trial forming of each of the drive sources and the target speed for the production forming is within a predetermined speed difference or not, and when it is not within the predetermined speed difference, a speed increment $\Delta V'$ is prepared and the speed increment $\Delta V'$ is added to the speed of each of the drive sources to make the speed closer to the target speed. As shown in step 7, the speed of each drive source n becomes V (speed during the previous trial forming)+$\Delta V_n$ (compensation increment)+$\Delta V'$ (speed increment).

In step 6, it is not necessary to perform judgment for all the drive sources, but judgment is performed for only one of the drive sources, and in accordance with the result, the speed increment $\Delta V'$ is added to the speeds of all the drive sources. For example, it is preferable that the drive source for which the judgment is performed is the reference drive source with the smallest delay among the drive sources. The drive source with the smallest delay among the drive sources is the one with the slowest speed, and therefore, the entire drive source speeds can be made to reach the target speed in a short time by a small number of repetitions of the loop for correcting the speed. The speed increment prepared and added here is preferably set at about ⅓ of the difference between the target speed and the previous trial forming speed when the determination and the loop of correcting the speed are repeated about three times. If the speed is increased too abruptly, a large inclination occurs to the slide plate during the next trial forming and a trouble sometimes occurs. Therefore, it is suitable to prepare a proper speed increment experimentally or in simulation.

When the difference between the speed of the drive source during the previous trial forming and the target speed for the production forming is within the predetermined speed difference in the judgment of step 6, the flow goes to step 8. In step 8, the speed of each drive source n is set to be V (speed during the previous trial forming)+$\Delta V_n$ (compensation increment). Here, the speed of the drive source is high enough to be able to be used in the production forming, and therefore, only the compensation increment for correcting the slide plate inclination is added.

When the difference between any of the maximums $\delta_n$ (n: a, b, c, d) of the delays of the actual displacements of the drive sources from the instructed displacement and the reference delay $\delta_{min}$ is less than or equal to the first predetermined value $\alpha 1$, it is not necessary to prepare a compensation increment to correct the slide plate inclination. Thus, the flow goes to step 9, and it is judged whether the speed of the drive source is the target speed for the production forming or not, like in step 6. It is determined whether the difference between the speed of the drive source during the previous trial forming and the target speed for the production forming is within the predetermined speed difference or not, and when it is not within the predetermined speed difference, the flow goes to step 10. In step 10, the speed is set at the speed which is prepared by adding a speed increment $\Delta V'$ to the speed of each of the drive sources. This is described for step 7 in the above, and therefore, refer to the explanation.

In steps 7, 8 and 10, the speed $V_n$ of each drive source n is set at V (speed during the previous trial forming)+$\Delta V_n$ (compensation increment)+$\Delta V'$(speed increment), and the flow returns to step 2 to perform retrial forming. Subsequently, the delay of each of the drive sources from the instructed displacement is measured during the trial forming (step 3), the difference between the delay of each of the drive sources and the reference delay is compared with the first predetermined value $\alpha 1$ (step 4), and the speed of the drive source during the previous trial forming is compared with the target speed for the production forming (step 6 and step 9). Until the difference between the delay of each of the drive sources and the reference delay becomes less than or equal to the first predetermined value $\alpha 1$, and until the difference between the speed during the trial forming and the target speed is within the predetermined speed difference, step 5 for preparing the compensation increment $\Delta V_n$ and the loop of preparing the speed increment $\Delta V'$, resetting the speed of each of the drive sources in steps 7, 8 and 10 and performing the trial forming are repeated.

When the difference between the delay of each of the drive sources and the reference delay is less than or equal to the first predetermined value $\alpha 1$ in step 4, and when the difference between the speed of the drive source and the target speed is within the predetermined speed difference in step 9, the flow goes to step 15, and production forming of the work-piece can be performed by driving each of the drive sources at the speed set at this time. In the production forming, the speed of each of the drive sources is set to be the speed close to the target speed for the production forming, and therefore, press-forming can be performed at a high forming speed suitable for the production forming.

However, the slide plate inclination is adjusted, based on the judgment whether the delay difference is less than or equal to the first predetermined value $\alpha 1$ or not in step 4. The first predetermined value $\alpha 1$ is a comparatively large value to an extent which does not cause damage to the mold, and therefore, it cannot be said that accuracy of the products is sufficiently ensured. Therefore, a second predetermined value $\alpha 2$ which is a smaller judgment value can be used in step 4 in order to see whether the inclination is small enough to ensure the accuracy of the products.

Alternatively, in step 11, the difference between the delay of each of the drive sources and the reference delay is judged about whether or not it is larger than the second predetermined value $\alpha 2$ which is smaller than the first predetermined value $\alpha 1$ and is the judgment value to the extent to ensure sufficient accuracy of the product, and when the difference between the delay of each of the drive sources and the reference delay is larger than the second predetermined value $\alpha 2$, the flow goes to step 12 and on. In step 12, an additional compensation increment of the speed of the drive source is prepared in accordance with the difference between the delay of each of the drive sources and the reference delay, the drive source speed is finely adjusted by using it, and trial forming of a work-piece is performed again in step 13. During the trial forming, the delay of each of the drive sources is measured in step 14, then the loop is repeated until the difference between the delay of each of the drive sources and the reference delay becomes less than or equal to the second predetermined value $\alpha 2$, and when the difference between the delay of each of the drive sources and the reference delay becomes less than or equal to the second predetermined value $\alpha 2$, the flow goes to step 15, where the production forming of a work-piece is performed. In this manner, a production forming can be performed at high forming speed suitable for the production forming when the work-pieces are manufactured in production forming, and the slide plate inclination to the extent of ensuring sufficient product accuracy is obtained.

INDUSTRIAL APPLICABILITY

When work-pieces are press-formed while the horizontal state of the slide plate is maintained by a feedback control, much time is taken for one cycle of the press-forming. However, if the production forming is performed by setting the speed of each of the drive sources so that the horizontal state of the slide plate can be maintained as in the invention, high descending speed of the slide plate can be selected in the production forming, and therefore, during press-forming, the forming can be performed at high forming speed suitable for production forming while the slide plate is maintained horizontal to the extent of ensuring sufficient product accuracy.

The invention claimed is:

1. A press forming method comprising the steps of providing a press machine comprising a fixed plate, a slide plate disposed to face the fixed plate and movable relatively to the fixed plate, a plurality of drive sources each having a servo-motor for driving the slide plate and pressing each of a plurality of engaging portions positioned on the slide plate to press horizontally the slide plate, displacement measuring devices are provided near the respective engaging portions to measure a displacement of the slide plate, a control device for control driving of each of the drive sources, and press-forming a work-piece at descending speeds of the plurality of drive sources in a trial forming, the descending speeds being set to be sufficiently small and same among the plurality of drive sources at an initial stage of the trial forming and then adjusted so as to be close to target speeds of a production forming and so that a delay difference between a displacement of each of the plurality of drive sources and an instructed displacement is less than a predetermined value, by a delay adjustment step among the drive sources and a driving speed increasing step, wherein, in the delay adjustment step, each of the descending speeds for the plurality of driving sources is adjusted by such a speed increment that the delay difference becomes less than or equal to the predetermined value, and, in the driving speed increasing step, the descending speeds for the plurality of driving sources are adjusted to increase more than in the delay adjustment step and close to the target speeds of the production forming.

2. A press forming method comprising the steps of:

providing a press machine comprising a fixed plate, a slide plate disposed to face the fixed plate and movable relatively to the fixed plate, a plurality of drive sources each having a servo-motor for driving the slide plate and pressing each of a plurality of engaging portions positioned on the slide plate to press horizontally the slide plate, displacement measuring devices are provided near the respective engaging portions to measure a displacement of the slide plate, a control device for control driving of each of the drive sources, and press-forming a work-piece at sufficiently small and same descending speeds among the plurality of drive sources in a trial forming, measuring a displacement delay of each of the plurality of drive sources from an instructed displacement during the trial forming, comparing a difference between a displacement delay (hereinafter referred to as "reference delay") of a drive source (hereinafter referred to as "reference drive source") among the plurality of drive sources from the instructed displacement and a displacement delay of each of other drive sources than the reference drive source from the instructed displacement with a predetermined value and comparing a descending speed of each of the plurality of drive sources during the trial forming with a target speed of the drive source for a production forming, if the difference between the reference delay and the displacement delay of one of the other drive sources is more than the predetermined value, preparing a speed increment (hereinafter referred to as "compensation increment") for the one of the other drive sources, corresponding to the difference between the reference delay and the displacement delay so as to eliminate the difference between the reference delay and the displacement delay for the one of the other drive sources to add the compensation increment to the descending speed of the trial forming for the one of the other drive sources, if a difference between the descending speed of each of the plurality of drive sources during the trial forming and the target speed of the drive source for the production forming is more than a predetermined speed difference, preparing a speed increment so as to make the descending speed close to a target speed for the drive source to add the speed increment to the descending speed, press-forming a work-piece at descending speeds adjusted with the compensation increment and/or the speed increment for a repeated trial forming, measuring a displacement delay of each of the plurality of drive sources from an instructed displacement during the repeated trial forming, comparing a difference between a reference delay of a reference drive source among the plurality of drive sources and a displacement delay of each of other drive sources than the reference drive source from the instructed displacement with the predetermined value and comparing the adjusted descending speed with the target speed for the production forming, repeating the step of preparing the compensation increment and the steps following the step of preparing the compensation increment, until the difference between the reference delay and the displacement delay becomes less than or equal to the predetermined value and until the difference between the descending speed and the target speed becomes within the predetermined speed difference, and if the difference between the reference delay and the displacement delay becomes less than or equal to the predetermined value and the difference between the descending speed and the target speed becomes within the predetermined speed difference, press-forming a work-piece at the descending speed for each of the plurality of drive sources in a production forming.

3. A press forming method as set forth in claim 2, wherein the reference drive source is a drive source having a minimum displacement delay from the instructed displacement at a displacement among the plurality of drive sources.

4. A press forming method as set forth in claim 2, wherein the predetermined value for comparing the difference between the reference delay and the displacement delay of each of the other drive sources is a first predetermined value, and the method further comprises:

judging whether or not the difference between the reference delay and the displacement delay of each of the other drive sources is more than a second predetermined value that is less than the first predetermined value, if, in any of the steps of comparing the difference and the descending speed, the difference is less than or equal to the first predetermined value and a difference between a descending speed of a drive source in the trial forming and the target speed is within the predetermined speed difference, if the difference between the reference delay and the displacement delay is more than the second predetermined value, preparing an additional compensation increment, corresponding to the difference between the reference delay and the displacement delay, to add the additional compensation increment to the descending speed of the drive source, repeating the steps of judging and preparing, until the difference between the reference delay and the displacement delay becomes less than or equal to the second predetermined value, and if the difference between the reference delay and the displacement delay becomes less than or equal to the second predetermined value, press-forming a work-piece in a production forming.

5. A press forming method as set forth in claim 3, wherein the predetermined value for comparing the difference between the reference delay and the displacement delay of each of the other drive sources is a first predetermined value, and the method further comprises:

judging whether or not the difference between the reference delay and the displacement delay of each of the other drive sources is more than a second predetermined value that is less than the first predetermined value, if, in any of the steps of comparing the difference and the descending speed, the difference is less than or equal to the first predetermined value and a difference between a descending speed of a drive source in the trial forming and the target speed is within the predetermined speed difference, if the difference between the reference delay and the displacement delay is more than the second predetermined value, preparing an additional compensation increment, corresponding to the difference between the reference delay and the displacement delay, to add the additional compensation increment to the descending speed of the drive source, repeating the steps of judging and preparing, until the difference between the reference delay and the displacement delay becomes less than or equal to the second predetermined value, and if the difference between the reference delay and the displacement delay becomes less than or equal to the second predetermined value, press-forming a work-piece in a production forming.

* * * * *